US006016416A

United States Patent [19]

Kitamura

[11] Patent Number: 6,016,416

[45] Date of Patent: Jan. 18, 2000

[54] IMAGE RECORDING APPARATUS HAVING A DRUM AND A ROLLER WITH INTERMESHING GEARS

[75] Inventor: Makoto Kitamura, Tokyo, Japan

[73] Assignee: Oki Data Corporation, Tokyo, Japan

[21] Appl. No.: 09/150,043

[22] Filed: Sep. 9, 1998

[30] Foreign Application Priority Data

Sep. 11, 1997 [JP] Japan ..... 9-246933

[51] Int. Cl.[7] ..... G03G 15/00

[52] U.S. Cl. ..... 399/167

[58] Field of Search ..... 399/75, 113, 116, 399/119, 167, 234

[56] References Cited

U.S. PATENT DOCUMENTS 4,330,198 5/1982 Matsumoto et al. ..... 399/234
5,126,800 6/1992 Shishido et al. ..... 399/167 X
5,323,213 6/1994 Ahn ..... 399/75
5,745,824 4/1998 Yashiro ..... 399/113

*Primary Examiner*—Fred L. Braun
*Attorney, Agent, or Firm*—Rabin & Champagne, PC

[57] ABSTRACT

An image recording apparatus has a photoconductive drum and a roller, e.g., developing roller, in pressure contact with the photoconductive drum. The photoconductive drum rotates on its rotational axis and has drum gears rotatable about the rotational axis. The drum gears are at opposite ends of the rotational axis. The roller is in pressure contact with the photoconductive drum and rotates on its rotational axis substantially parallel with the rotational axis of the photoconductive drum. The roller has roller gears rotatable about its rotational axis. The roller gears are at opposite ends of the rotational axis and in mesh with the drum gears. At least one of the roller gears is provided with a one-way clutch which is locked only when a drive force is applied to the roller gear.

5 Claims, 4 Drawing Sheets

IMAGE RECORDING APPARATUS HAVING A DRUM AND A ROLLER WITH INTERMESHING GEARS

BACKGROUND OF THE INVENTION

1. Field of the Invention

The present invention relates to an image recording apparatus, and more particularly to an electrophotographic printer.

2. Description of the Related Art

FIG. 2 illustrates the drive mechanism for a conventional art image recording apparatus.

The surface of a photoconductive drum 11 is uniformly negatively charged by a charging roller, not shown. An exposing unit such as an LED head array, not shown, illuminates the charged surface of the photoconductive drum 11 to form an electrostatic latent image thereon. Toner is supplied to a developing roller 12 from a toner cartridge, not shown, and is rubbed against the developing roller 12 by a developing blade, not shown, into a negatively charged toner layer. The toner applied on the developing roller 12 is then deposited to the electrostatic latent image to develop the electrostatic latent image into a toner image. The toner image is subsequently transferred by a transfer roller 13 to a print medium, not shown.

After the transfer operation, a small amount of toner is left on the surface of the photoconductive drum 11 and is removed by a cleaning roller, not shown, which is provided downstream of the transfer roller 13 with respect to the rotation of the photoconductive drum 11 and rotated in contact with the photoconductive drum 11.

A motor 14 in the form of, for example, a stepping motor or DC servo motor is provided. The rotation of the motor 14 is transmitted via a gear train to the photoconductive drum 11, charging roller, developing roller 12, transfer roller 13, and cleaning roller, so that the drum and rollers are rotated in directions shown by respective arrows.

A motor gear 21 mounted to a shaft, not shown, of the motor 14 is in mesh with a double gear 22 which in turn is in mesh with another double gear 23. The double gear 23 is in mesh with a gear 24 which is in mesh with a drum gear 15. Thus, the rotation of the motor 14 is reduced by a gear train constructed of the motor gear 21, double gears 22 and 23, and gear 24 before being transmitted to the drum gear 15.

The photoconductive drum 11 has the drum gear 15 at one longitudinal end thereof and a drum gear 16 at the other end. The developing roller 12 has a developing roller gear 17, and the transfer roller 13 has a transfer roller gear 18 at a location remote from the developing roller gear 17. The rotation of the photoconductive drum 11 is transmitted to the developing roller 12 via the drum gear 15, and to the transfer roller 13 via the drum gear 16.

The drum gear 16 and the transfer roller gear 18 are spur gears. The drum gear 15, developing roller gear 17, motor gear 21, double gears 22 and 23, and gear 24 are helical gears which transmit rotation smoothly.

With the aforementioned conventional art, the developing roller 12, transfer roller 13, and cleaning roller are in pressure contact with the photoconductive drum 11. Therefore, excess loads are exerted on the drum gears 15 and 16, developing roller gear 17, and transfer roller gear 18, so that the gears are deformed or twisted, resulting in variations in the pitches of the respective gears. Variations in pitches cause changes in rotation of the respective rollers, resulting in poor print quality.

The toner is charged by causing the developing roller 12 to rotate relative to the photoconductive drum 11 with friction therebetween. For this purpose, the photoconductive drum 11 and the developing roller 12 have different circumferential speeds, creating a frictional resistance between the photoconductive drum 11 and developing roller 12. The frictional resistance adds to the load on the drum gear 15 and developing roller gear 17, further causing the pitches of the drum gears 15 and developing roller gear 17 to change.

As a result, when a gray-scale image, not shown, is to be printed, variation in the rotation of developing roller 12 causes lateral stripes or lines in the print, resulting in poor print quality.

In order to deposit the toner on the developing roller 12 to the photoconductive drum 11, it is necessary to ensure that the photoconductive drum 11 has a substantially uniform area in contact with the developing roller 12 along the rotational axes of the photoconductive drum 11 and developing roller 12. However, when the rotation of the photoconductive drum 11 is transmitted to the developing roller 12, the drum gear 15 and the developing roller gear 17 tend to repel each other, causing a longer distance between the axes of the photoconductive drum 11 and developing roller 12.

FIG. 3 illustrates the relation between the drum gear 15 and the developing roller gear 17 of the conventional image recording apparatus. FIGS. 4A–4B illustrates a nip between the drum gear 15 and the developing roller gear 17.

Referring to FIG. 3, when the rotation of the photoconductive drum 11 is transmitted to the developing roller 12 via the drum gear 15 and developing roller gear 17, tooth surfaces S1 and S2 contact each other at an angle $\alpha$ equal to a pressure angle with respect to a line connecting center axes O1 and O2. The tooth surface S2 receives a drive force F in a direction at an angle of $\alpha$ with respect to a line between and tangent to pitch circles Ci1 and Ci2.

Thus, a component $F_Y$ of the drive force F, given by $F_Y = F \cdot \sin \alpha$, acts in a direction parallel to the line connecting the center axes O1 and O2, so that the drum gear 15 and developing roller gear 17 repel each other. As a result, the distance between the center axes O1 and O2 becomes longer.

Due to the fact that the drum gear 15 and developing roller gear 17 are provided on longitudinal one ends of the photoconductive drum 11 and the developing roller 12, respectively, when the photoconductive drum 11 and developing roller 12 rotate, the photoconductive drum 11 and the developing roller 12 move away from each other at the right end so that the position of the longitudinal axis of the developing roller 12 center line is displaced from X to X' as shown in FIG. 4B. As a result, a nip between the photoconductive drum 11 and the developing roller 12 is not uniform along the lengths of the photoconductive drum 11 and developing roller 12. The nip is n at the left ends of the photoconductive drum 11 and the developing roller 12 but n-$\delta$n at the right ends.

Less toner is charged with a decreasing size of the nip, so that the amount of toner deposited to the photoconductive drum 11 decreases along the length of the photoconductive drum 11. A decrease in the amount of toner causes lower density or an absence of toner in print. Insufficiently charged toner left on the photoconductive drum 11 after transferring is difficult to completely recover from the photoconductive drum 11. Such insufficiently charged residual toner builds up in the form of lines or stripes on the surface of the photoconductive drum 11 and may adhere to another print medium, thereby exposing the print medium to contamination.

SUMMARY OF THE INVENTION

An object of the invention is to provide an image recording apparatus where the respective rollers are rotated without fluctuation in rotation.

Another object of the invention is to provide an image recording apparatus which maintains print quality and eliminates the partial absence of toner in the print due to insufficient transfer of toner and the soiling of a print medium due to the insufficiently charged residual toner.

Another object of the invention is to provide an image recording apparatus which does not expose the print medium to contamination.

An image recording apparatus has a photoconductive drum and a roller in pressure contact with the photoconductive drum. The photoconductive drum has a first rotational axis and drum gears rotatable about the first rotational axis. The drum gears are at opposite ends of the rotational axis. The roller is in pressure contact with the photoconductive drum and has a second rotational axis substantially parallel with the first rotational axis. The roller has roller gears rotatable about the second rotational axis. The roller gears are at opposite ends of the second rotational axis and in mesh with the drum gears. At least one of the roller gears is provided with a one-way clutch which is locked only when a drive force is applied to the roller gear. The roller gears and drum gears are helical gears.

The roller may be a developing roller. The developing roller and the photoconductive drum rotate different circumferential speeds.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

Figure 1:
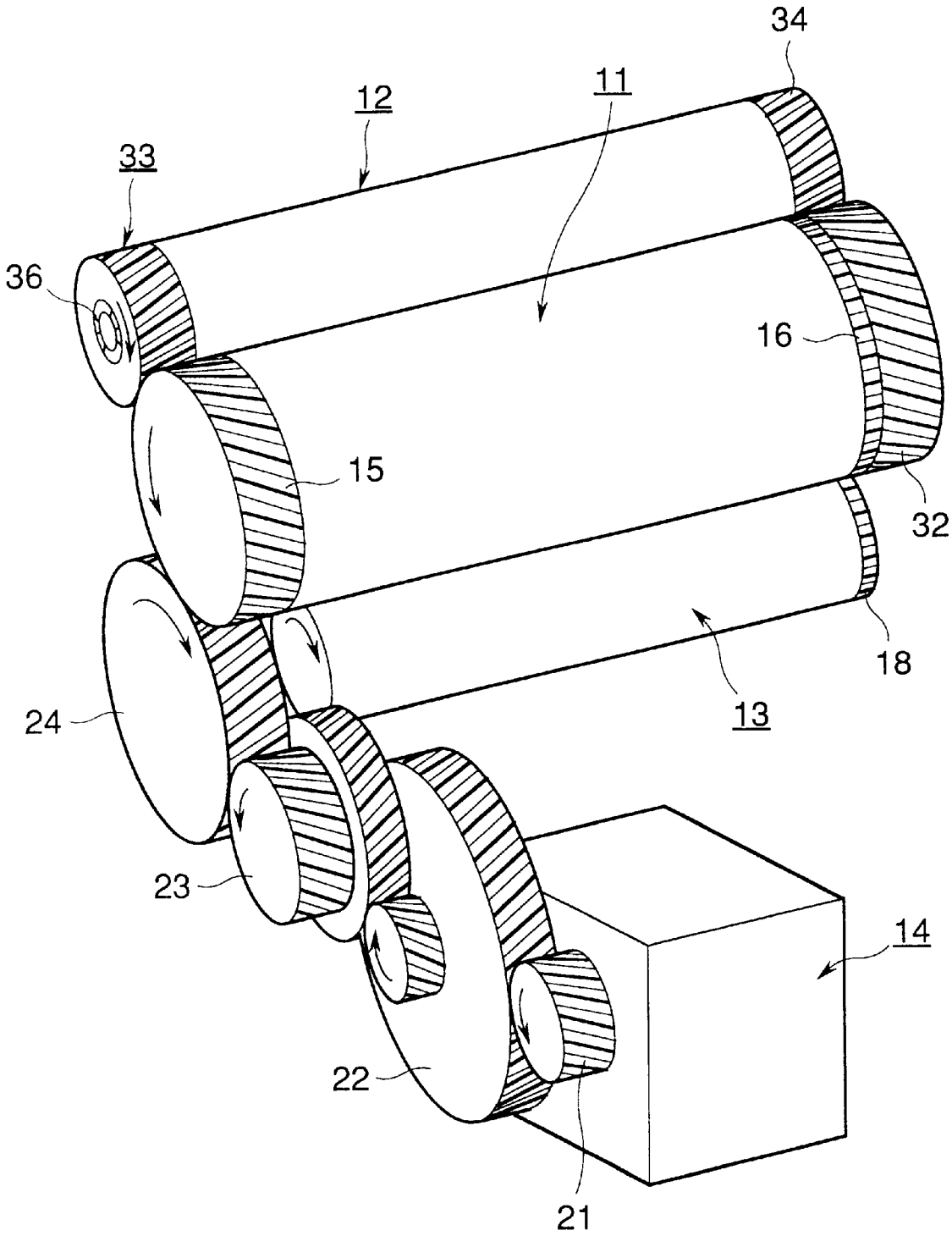
FIG. 1 is a drive mechanism of an image recording apparatus according to an embodiment of the invention.
Figure 2:
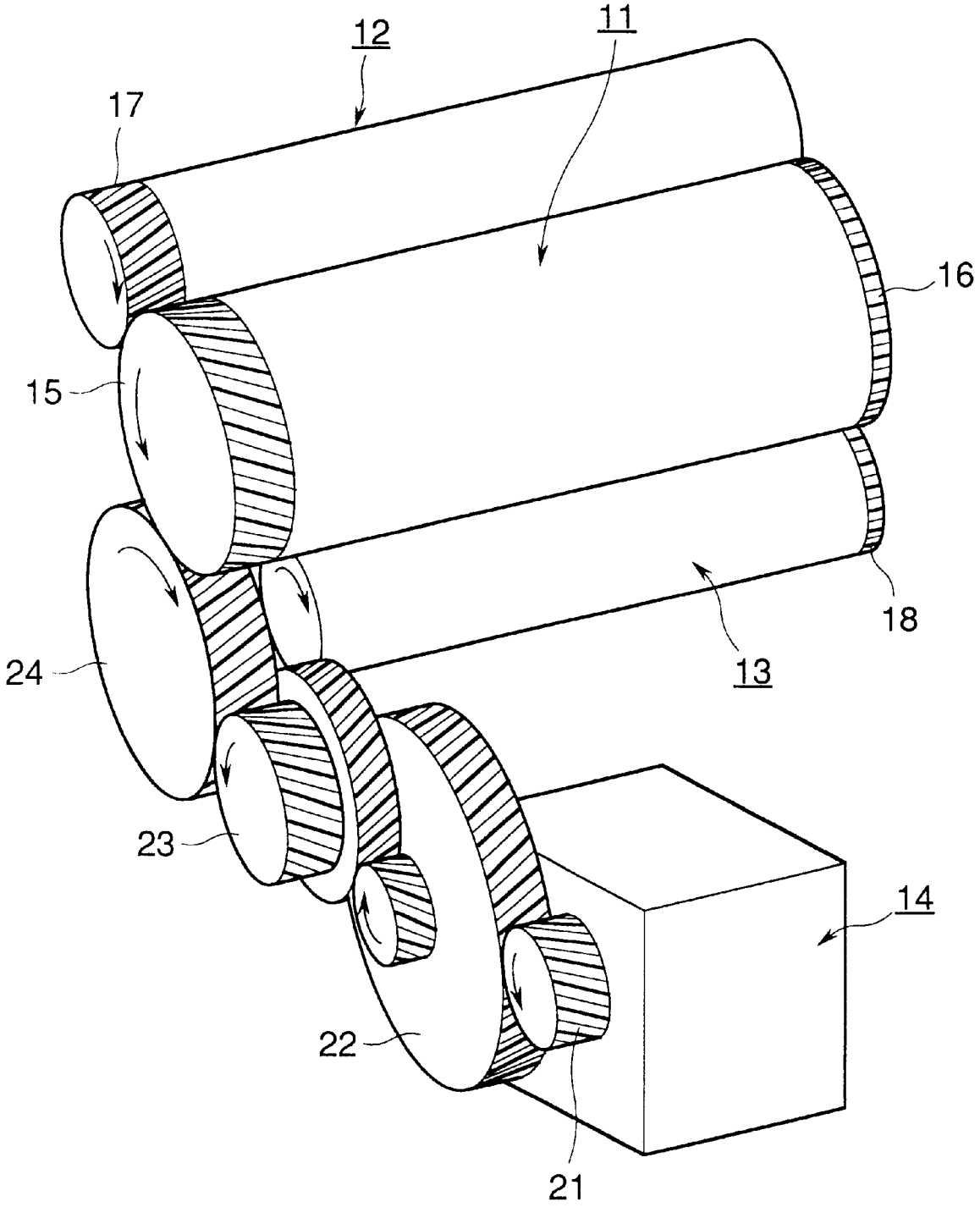
FIG.2 CONVENTIONAL ART
FIG. 2 illustrates the drive mechanism for a conventional art image recording apparatus.

FIG. 1 is a drive mechanism of an image recording apparatus according to an embodiment of the invention.

Referring to FIG. 1, the surface of a photoconductive drum 11 is uniformly negatively charged by a charging roller, not shown. An exposing unit such as an LED head array, not shown, illuminates the charged surface of the photoconductive drum 11 to form an electrostatic latent image thereon. Toner is supplied to a developing roller 12 from a toner cartridge, not shown, and is rubbed against the developing roller 12 by a developing blade, not shown, into a negatively charged toner layer. The toner layer formed on the developing roller is then deposited to the electrostatic latent image to develop the electrostatic latent image into a toner image. The toner image is subsequently transferred by a transfer roller 13 to a print medium, not shown.

After the transfer operation, a small amount of toner is left on the surface of the photoconductive drum 11 and is removed by a cleaning roller, not shown, which is provided downstream of the transfer roller 13 with respect to the rotation of the photoconductive drum 11 and is rotated in contact with the photoconductive drum 11.

A motor 14 in the form of, for example, a stepping motor or a DC servo motor is provided. The rotation of the motor 14 is transmitted via a gear train to the photoconductive drum 11, charging roller, developing roller 12, transfer roller 13, and cleaning roller, so that the photoconductive drum 11 and rollers are rotated in directions shown by the respective arrows.

A motor gear 21 mounted to a shaft, not shown, of the motor 14 is in mesh with a double gear 22 which in turn is in mesh with another double gear 23. The double gear 23 is in mesh with a gear 24 which is in mesh with a drum gear 15. Thus, the rotation of the motor 14 is reduced by a gear train constructed of the motor gear 21, double gears 22 and 23, and gear 24 before being transmitted to the drum gear 15. The gears 15, 21–24, and 32–34 are helical gears which smoothly transmit rotation.

The photoconductive drum 11 has a drum gear 15 at one longitudinal end thereof and a drum gear 16 at the other end. The photoconductive drum 11 is also provided with an additional drum gear 32 which is adjacent to the drum gear 16 and drives the developing roller 12 in rotation. The developing roller 12 has a developing roller gear 33 at one end thereof and another developing roller gear 34 at the other end thereof. The developing roller gear 33 is in mesh with the drum gear 15 and the developing roller gear 34 is in mesh with the drum gear 32. The transfer roller 13 has a transfer roller gear 18 which is provided at one longitudinal end of the transfer roller 13 and in mesh with the drum gear 16.

The rotation of the photoconductive drum 11 is transmitted to the developing roller 12 via the drum gear 15 and developing roller gear 33, and the drum gear 32 and developing roller 34. The rotation of the photoconductive drum 11 is also transmitted to the transfer roller 13 via the drum gear 16 and transfer roller gear 18.

If the photoconductive drum 11 and developing roller 12 are assembled together with the teeth of the drum gear 15 out of phase with respect to those of the drum gear 32 or with the teeth of the developing gear 33 out of phase with respect to those of the developing gear 34, the photoconductive drum 11 cannot be properly positioned relative to the developing roller 12 so that they are not in intimate contact with each other. In order to solve this drawback, there is provided a one-way clutch 36 to the developing roller gear 33. When a rotation in a direction opposite to the drive direction is transmitted to the developing roller gear 33, the one-way clutch rotates freely so that a drive force is not transmitted from the drive gear 15 to the developing roller gear 33. When a rotation in the drive direction is transmitted to the developing roller gear 33, the one-way clutch is locked so that a drive force is transmitted from the drive gear 15 to the developing roller gear 33. Therefore, the one-way clutch 36 absorbs a phase difference even if the photoconductive drum and the developing roller 12 are assembled together with the drum gears 15 and 32 out of phase with each other and/or with the developing roller gears 33 and 34 out of phase with each other. The one-way clutch may be provided to the developing roller gear 34 or to both developing roller gears 33 and 34.

The toner used is of a single non-magnetic composition. The toner is charged triboelectrically by causing the photoconductive drum 11 and the developing roller 12 to rotate with friction developed therebetween. For this purpose, the photoconductive drum 11 rotates relative to the developing roller 12 with a predetermined difference in tangential velocities therebetween, thereby creating a friction between the photoconductive drum 11 and the developing roller 12. There are the following relations between the gears 15 and 32 and the photoconductive drum 11.

$$d1>d3$$

where d1 is the diameter of the pitch circles of the drum gears 15 and 32 and d3 is the diameter of the photoconductive drum 11.

There are also the following relations between the gears 33 and 34 and the developing roller 12.

$$d2<d4$$

where d2 is the diameter of the pitch circles of the developing roller gears 33 and 34 and d4 is the diameter of the developing roller 12.

Further, there are the following relations between the diameter d5 of the pitch circle of the drum gear 16 and the diameter d3 of the photoconductive drum 11, and between the pitch circle d6 of the transfer roller gear 18 and the diameter d7 of the transfer roller 13.

$$d5/d6=d3/d7$$

Therefore, the photoconductive drum 11 and the transfer roller 13 rotate at the same tangential velocity.

The drum gears 15 and 32 and the developing roller gears 33 and 34 receive large loads due to the fact that the photoconductive drum 11 and the developing roller 12 are in pressure contact with each other. Moreover, an additional load is exerted on the drum gears 15 and 32 and developing roller gears 33 and 34 due to a friction developed by the difference in circumferential speed between the photoconductive drum 11 and the developing roller 12 which are in pressure contact with each other.

The drum gear 15 meshes with the developing gear 33 at one longitudinal end of the photoconductive drum 11 while the drum gear 32 meshes with the developing roller gear 34 at the other, so that the rotation of the photoconductive drum 11 is transmitted to the developing roller 12. This way of transmitting the rotation of the photoconductive drum 11 will not cause the drum gears 15 and 32 and the developing roller gears 33 and 34 to deform or twist, thus preventing the pitch of the developing roller gears 33 and 34 from varying. Further, this way of transmitting the rotation of the photoconductive drum 11 eliminates the fluctuations in the rotations of the photoconductive drum 11 and developing roller 12, thereby preventing print quality from being impaired. The resulting smooth rotation eliminates the fluctuation in rotation of the developing roller 12, so that lateral lines or strips will not appear on the print medium particularly when a gray-scale image is printed.

Figure 5:
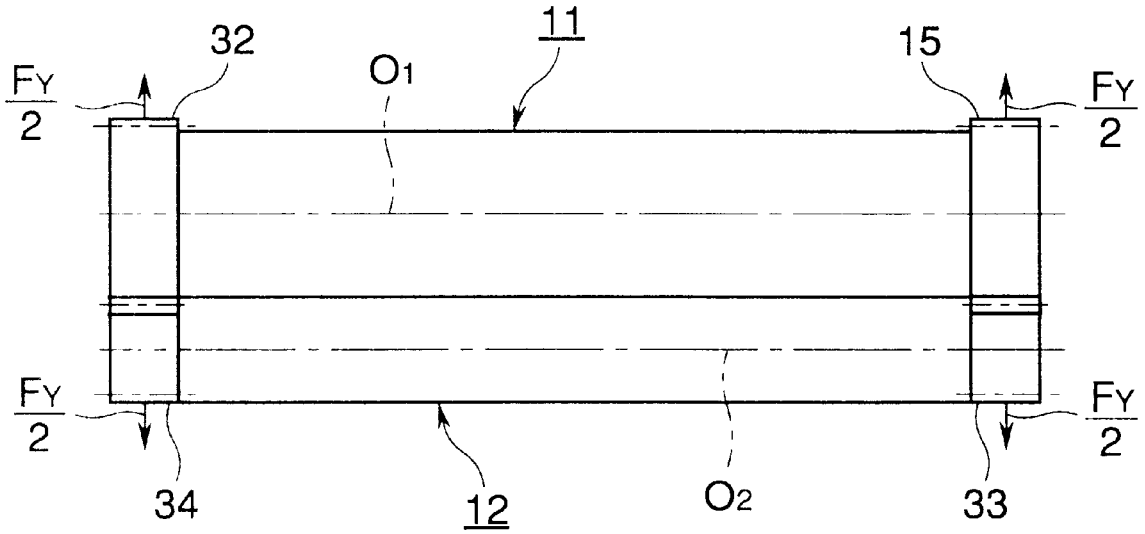
FIG. 5 illustrates the relation between the drum gear and the developing roller gear according to the embodiment.

FIG. 5 illustrates the relation between the drum gear and the developing roller gear according to the embodiment.

Figure 3:
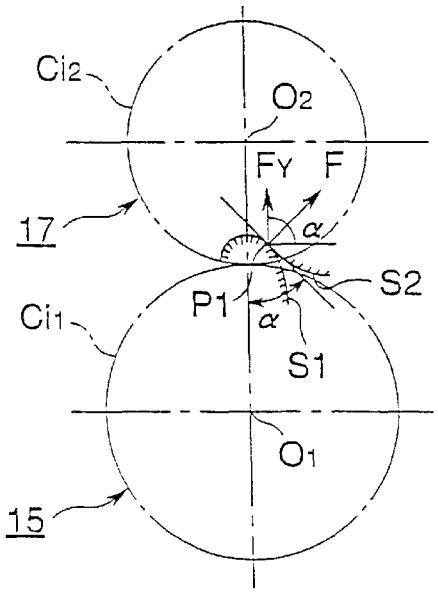
FIG. 3 CONVENTIONAL ART
FIG. 3 illustrates the relation between the drum gear 15 and the developing roller gear 17 of the conventional image recording apparatus.
Figure 4A:
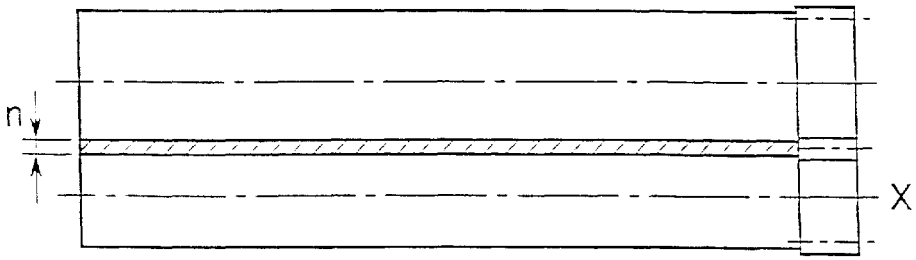
FIG.4A CONVENTIONAL ART
FIGS. 4A and 4B illustrate the size of a nip in the conventional image recording apparatus.
Figure 4B:
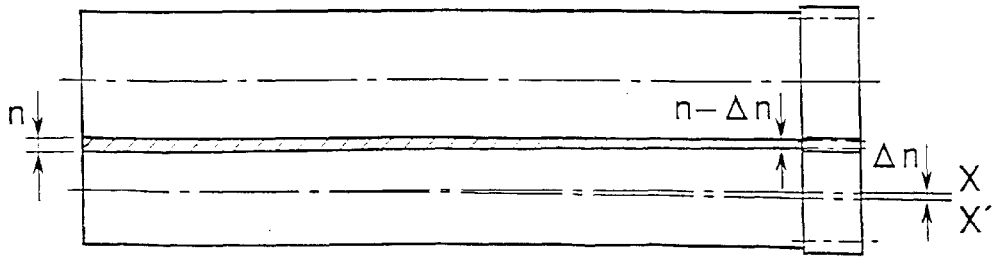
FIG.4B CONVENTIONAL ART

The respective tooth surfaces of the drum gears 15 and 32 and developing gears 33 and 34 contact with each other at an angle $\alpha$ (FIG. 3), equal to the pressure angle, with respect to the line connecting the center axes O1 and O2 (FIG. 3). When the photoconductive drum 11 is rotated, the total drive force applied to the developing roller 12 is resolved into two substantially equal components; one being transmitted via the drum gear 15 and developing roller gear 33 and another being transmitted via the drum gear 32 and developing roller gear 34. Thus, the drive force exerted on each end of the developing roller 12 is half that of the conventional art where the developing roller 12 is driven in rotation only at one end thereof by the photoconductive drum 11. Consequently, the component $F_Y$ acting in such a direction as to repel the photoconductive drum and the developing roller 12 away from each other becomes half that of the conventional art.

Since the drum gears 15 and 32 and the developing roller gears 33 and 34 are not deformed, the nip between the photoconductive drum 11 and the developing roller 12 is substantially uniform along their lengths, allowing substantially uniform deposition of toner onto the surface of the photoconductive drum 11. Such a uniformly formed nip allows the toner to be sufficiently and uniformly charged along the length of the photoconductive drum 11, preventing print density from decreasing and toner from being absent in the print. Moreover, sufficiently charged toner is easily recovered by the developing roller and the cleaning roller. Sufficiently recovering the residual toner eliminates the possibility of developer toner clinging to the surface areas not exposed to the electrostatic latent image and prevents contamination of the print medium resulting from toner deposited in a belt-like shape on the surface of the photoconductive drum 11.

While the invention has been described with respect to a developing roller 12 in pressure contact with the photoconductive drum 11, the invention is also applicable to the charging roller, transfer roller, and cleaning roller that are in pressure contact with the photoconductive drum 11.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus, comprising:

a photoconductive drum having a first rotational axis and drum gears rotatable about the first rotational axis, the drum gears being fixedly mounted to said photoconductive drum at opposite ends of the rotational axis;

a roller in pressure contact with said photoconductive drum, said roller having a second rotational axis substantially parallel to the first rotational axis, and having roller gears rotatable about the second rotational axis, the roller gears being fixedly mounted to said roller at opposite ends of the second rotational axis, the roller gears being in mesh with the drum gears;

wherein at least one of the roller gears is provided with a one-way clutch which is locked only when a drive force is applied to the roller gear, whereby a surface of said roller is in uniform pressure contact with a surface of said drum between the respective gears, and along respective lengths of said drum and said roller.

2. The image recording apparatus according to claim 1, wherein the roller is a developing roller, and said developing roller rotates at a first speed, so that the surface of said developing roller moves at a first tangential velocity, and said photoconductive drum rotates at a second speed, so that the surface of said photoconductive drum moves at a second tangential velocity that is different from the first tangential velocity, and so that the surface of the developing roller frictionally engages with the surface of the photoconductive drum.

3. The image recording apparatus according to claim 2, wherein the gears of said developing roller have a pitch circle having a first diameter, the gears of said photoconductive drum have a pitch circle having a second diameter, the photoconductive drum has a third diameter, and the developing roller has a fourth diameter; and wherein the second diameter is greater than the third diameter, and the first diameter is less than the fourth diameter.

4. The image recording apparatus according to claim 1, wherein the roller gears and the drum gears are helical gears.

5. The image recording apparatus according to claim 1, wherein the drum gears comprise a pair of drum gears, each being locatable on opposite longitudinal ends of said drum, and wherein the roller gears comprise a pair of roller gears, each being locatable on opposite longitudinal ends of said roller; and wherein said one-way clutch is free to rotate when the drive force is not applied to the roller gear, whereby said one-way clutch absorbs a phase difference between at least one of said pair of drum gears and said pair of roller gears to ensure that said drum gears and said roller gears are in phase when said drum gears are engaged with said roller gears.

* * * * *